US009481007B2

(12) United States Patent
Rzonca et al.

(10) Patent No.: US 9,481,007 B2
(45) Date of Patent: Nov. 1, 2016

(54) METHOD AND SYSTEM FOR REGULATING ADHESIVE APPLICATION

(75) Inventors: Gary Rzonca, Chanhassen, MN (US); Erin Johnson, San Francisco, CA (US)

(73) Assignee: HENKEL IP & HOLDING GMBH, Duesseldorf (DE)

( * ) Notice: Subject to any disclaimer, the term of this patent is extended or adjusted under 35 U.S.C. 154(b) by 851 days.

(21) Appl. No.: 13/528,441

(22) Filed: Jun. 20, 2012

(65) Prior Publication Data

US 2012/0259448 A1 Oct. 11, 2012

Related U.S. Application Data

(63) Continuation of application No. PCT/US2010/061211, filed on Dec. 20, 2010.

(60) Provisional application No. 61/288,400, filed on Dec. 21, 2009.

(51) Int. Cl.

| | |
|---|---|
| ***G06F 19/00*** | (2011.01) |
| ***B05C 11/00*** | (2006.01) |
| ***B05C 5/02*** | (2006.01) |
| ***B05C 11/10*** | (2006.01) |
| ***B31B 1/00*** | (2006.01) |

(52) U.S. Cl.

CPC ..... *B05C 5/0216* (2013.01); *B05C 5/022* (2013.01); *B05C 11/1002* (2013.01); *B05C 11/1021* (2013.01); *B31B 1/00* (2013.01); *B31B 2219/6007* (2013.01); *B31B 2219/95* (2013.01)

(58) Field of Classification Search

CPC . B05C 5/0216; B05C 5/022; B05C 11/1021; B05C 11/1002; B31B 1/00; B31B 2219/6007; B31B 2219/95

See application file for complete search history.

(56) References Cited

U.S. PATENT DOCUMENTS

| | | | | |
|---|---|---|---|---|
| 4,413,255 | A * | 11/1983 | Cohen | G01F 23/247 137/558 |
| 4,430,147 | A * | 2/1984 | Harston et al. | 156/578 |
| 4,433,237 | A * | 2/1984 | Matt | G01V 8/12 118/682 |
| 5,056,462 | A * | 10/1991 | Perkins | B05B 12/00 118/308 |
| 5,065,695 | A * | 11/1991 | Baron | B05C 11/1023 118/300 |
| 5,378,089 | A | 1/1995 | Law | |
| 5,687,092 | A * | 11/1997 | Bretmersky | G05D 7/0635 118/683 |
| 5,791,830 | A * | 8/1998 | Fort | B28B 13/021 406/151 |
| 5,807,606 | A * | 9/1998 | Mould | B05C 11/10 118/406 |
| 6,180,544 | B1 * | 1/2001 | Jauchen et al. | 442/150 |
| 6,286,202 | B1 * | 9/2001 | Asai | H05K 13/08 29/593 |
| 6,746,712 | B2 | 6/2004 | Hoffmann et al. | |
| 7,967,168 | B2 | 6/2011 | Geier et al. | |
| 8,383,991 | B2 * | 2/2013 | Ganzer | B29B 13/022 219/421 |
| 2004/0067448 | A1 * | 4/2004 | Lu | G03F 7/40 430/314 |
| 2005/0048195 | A1 | 3/2005 | Yanagita et al. | |

(Continued)

FOREIGN PATENT DOCUMENTS

| | | |
|---|---|---|
| DE | 29620763 U1 | 2/1997 |
| DE | 20100107 U1 | 4/2001 |

(Continued)

*Primary Examiner* — M. N. Von Buhr
(74) *Attorney, Agent, or Firm* — Sun Hee Lehmann

(57) ABSTRACT

A method and system used to regulate and control adhesive application on a substrate. The system includes a control unit operable to control pressure in the conduit system in response to the signals received from a mass flow meter. The control unit is further operable to regulate consistent and even application of adhesive to a substrate.

5 Claims, 4 Drawing Sheets

(56) References Cited

U.S. PATENT DOCUMENTS

2005/0048196 A1 3/2005 Yanagita et al.
2005/0095359 A1 5/2005 Pallante et al.
2005/0161468 A1* 7/2005 Wagner ..... 222/52
2006/0003591 A1* 1/2006 Cheng ..... G03F 7/168 438/725
2006/0016510 A1* 1/2006 Porter et al. ..... 141/2
2006/0189093 A1* 8/2006 Lu ..... C09J 9/00 438/455
2006/0201423 A1* 9/2006 Akimoto ..... G03F 7/162 118/712
2006/0286290 A1 12/2006 Wanthal et al.
2007/0062642 A1 3/2007 Reck et al.
2007/0080157 A1 4/2007 Mehaffy et al.
2008/0024602 A1* 1/2008 Linnenkohl ..... G01N 21/88 348/128
2008/0106023 A1* 5/2008 Kaneko ..... B42C 9/0018 270/18
2008/0107501 A1* 5/2008 Hattori ..... B05C 11/1002 412/37
2008/0112778 A1* 5/2008 Hattori ..... B42C 9/0018 412/37
2008/0190365 A1* 8/2008 Lasko ..... B05C 11/1042 118/623
2009/0095730 A1 4/2009 Ganzer et al.
2010/0000081 A1* 1/2010 Noda ..... H01L 24/75 29/739

FOREIGN PATENT DOCUMENTS

DE 10257567 A1 * 7/2004 ..... B05B 12/122
EP 1792663 A2 6/2007
GB 1205034 A * 9/1970 ..... B05C 1/027
JP 9225373 A 9/1997
JP 2007216148 A 8/2007
KR 20060133319 A * 12/2006 ..... G02F 1/1339
WO 03037527 A1 5/2003
WO 2009101039 A1 8/2009

* cited by examiner

PINCH BOTTOM ADHESIVE APPLICATION FIG. 3

METHOD AND SYSTEM FOR REGULATING ADHESIVE APPLICATION

CROSS-REFERENCE TO RELATED APPLICATIONS

This application is a continuation of International Patent Application No. PCT/US2010/061211 filed Dec. 20, 2010, which claims priority to U.S. Patent Application Ser. No. 61/288,400 filed Dec. 21, 2009, the contents of both of which are incorporated herein by reference.

FIELD OF THE INVENTION

This invention relates to a system and method for the controlled and accurate application of adhesives and/or sealants to substrate materials. Specifically, this invention is directed to increasing the quality of an adhesive application process on a substrate such as a bag.

BRIEF DESCRIPTION OF RELATED TECHNOLOGY

Adhesives are used in many industries to adhere one substrate to another. The effectiveness of the adhesive to bond the substrates hinges on the proper application of the adhesive during the application process. For example, the temperature of the adhesive, the amount of adhesive applied to the substrate, the consistency of the adhesive across the substrate, and the position of the adhesive applied on the substrate, all affect the quality of the adhesive bond. It is critical to meet the desired specifications for the application of the adhesive to prevent the production of defective products.

The packaging industry relies on proper adhesive application in the production of bags, such as a pinch bottom bag which is commonly used for packaging a wide variety of items such as pet food. An adhesive is applied to the bottom end of the bag along a portion of the bottom edge. The adhesive bottom edge is folded over and the adhesive seals the bottom end of the bag. An adhesive is similarly applied to the top end of the bag along a portion of the top edge. The adhesive is dried. The bags are shipped to a customer. The customer fills the bags with product, and seals the top end of the bag by heating up the pre-applied adhesive and folding the adhesive top edge over to seal the top end. If the adhesive is not properly applied to the bag ends then the bag ends will not seal properly and the product within the bags may spill out of the bag or spoil. The defective non-compliant bags increase the cost of manufacturing the bag. It also can result in costly rework, returns, and claims due to poor quality, along with other associated expenses and the potential for lost business and lost customers.

One type of adhesive dispenser used in such applications is shown in U.S. Pat. No. 6,746,712. A flow meter system is described that measures the flow of the adhesive and generates data regarding total adhesive used for the purpose of optimization. This system addresses one common problem in the industry directed to calculating and instructing the adhesive equipment to apply a calculated amount of total adhesive onto each individual bag.

However, little improvement has been done over the years to ensure proper application of the adhesive to a substrate. Thus, the industries rely on quality control checks to monitor the process. Monitoring the application of the adhesive is normally done by random sampling or visual checks during production.

The accuracy of such monitoring systems is low due to the limited capacity of the available methods used in the industry, external influences and human errors. For example, a mass flow meter is used to measure the amount of total adhesive applied to an individual bag. However, while the calculated amount of adhesive is applied to the bag, the mass flow meter or monitoring systems are not capable of verifying that the adhesive was applied evenly and consistently across the desired range on each bag. In one situation, the deposit of adhesive is too heavy at the beginning of the application process on the bag but it quickly thins out by the end of the application process on each bag. The bag would appear to be within the specifications because the total mass of the adhesive applied would be within the specification but in reality the application was not consistent across the width of the bag and the quality would be compromised.

Another problem associated with the application of adhesive is the positioning of the adhesive on the bag. The bags run through a production line and the adhesive is applied to the bag as it passes by the nozzle that dispenses the adhesive. If the bags are not properly aligned, then the adhesive would be applied on an angle, too high or too low along the edge, or there would be a void of adhesive due to a folded edge. Once the adhesive is applied to the bag there are no checks in place to verify the proper placement of the adhesive.

If the adhesive is applied inadequately to the bag, rejection of the bag is generally the result. Additionally, many processes that apply adhesives operate at high speeds which increase the number of rejected bags prior to shutting down the system to make corrections. By the time an operator recognizes and reacts to a non-compliant adhesive application the time delay is significant, resulting in increased waste of non-compliant bags. The time delay dramatically increases the economic costs associated with these rejected bags which is typically absorbed by the manufacture and results in reduced quality, reduced profits, and a reduced ability to compete.

There is a need to for a more accurate monitoring system that is able to provide a quicker response time to an error in the application of the adhesive. Additionally, there is a need to provide a monitoring system that monitors the entire process including monitoring the temperature of the adhesive prior to the application, the application of the adhesive consistently across the desire range of the substrate, and the positioning of the adhesive on each substrate at the end of the process. Additionally, there is a desire to reduce costs associated with the adhesive process including costs associated with returning and reworking non-compliant final product and reduced use of raw materials. Furthermore, there is a desire for reporting capabilities of a monitoring system for quality control purposes.

SUMMARY OF THE INVENTION

The present invention is directed to a system for regulated and controlled application of adhesive to substrates. The system includes a reservoir tank for containing a supply of adhesive, at least one applicator nozzle, conduit system for guiding the flow of adhesive from the reservoir tank to the nozzle, an application sensor located between the reservoir tank and the nozzle, a mass flow meter located between the application sensor and the nozzle; and a monitoring unit with an associated data processing program. The monitoring unit is operable to control pressure and temperature in the conduit system in response to the signals received from the mass flow meter. The monitoring unit is further operable to regulate consistent and even application of adhesive to a substrate.

The present invention is further directed to a method for regulating application of an adhesive to a substrate. The method includes the steps of inputting total target amounts of adhesive to deposit on a bag and bag dimensions into a monitoring unit. A graphical interface may be employed. The monitoring unit is employed to calculate bag area of the application of adhesive based on bag dimensions, and calculate target incremental deposits of adhesive to be applied on the bag at incremental measurements. The next step is measuring mass flow rate of an adhesive through a mass flow rate meter. The monitoring unit is used to calculate a measured incremental mass flow rate based on measurements transmitted by the mass flow rate meter and compare the measured incremental mass flow rate to the target incremental deposit to determine whether the measured incremental mass flow rate equals the target incremental deposit defining a result. The next step is to adjust the mass flow rate of the adhesive through the mass flow meter by adjustment of the pressure or temperature in response to the results.

The present invention is also directed to a method for the controlled application of adhesive to substrates including providing an adhesive application device including a reservoir tank for containing a supply of adhesive, a mass flow meter located between the tank and the nozzle, the reservoir tank and the nozzle being fluidly connected by a conduit system capable of transporting the adhesive, and a monitoring unit with an associated data processing program, the monitoring unit being operable to receive mass flow rate signals from the mass flow meter, and the monitoring unit being operable to control a pump and heating element. The next steps are employing the mass flow rate meter to measure the mass throughput of the adhesive defining measured mass flow data, and transmitting the measured mass flow data to the monitoring unit. The final steps include controlling the amount of adhesive, and controlling consistent and even application of the adhesive on the substrate at a plurality of points along the substrate by continuous monitoring the mass of adhesive to be applied and selectively adjusting the output of the pump and heating element response to the signals.

DETAILED DESCRIPTION OF THE INVENTION

Figure 1:
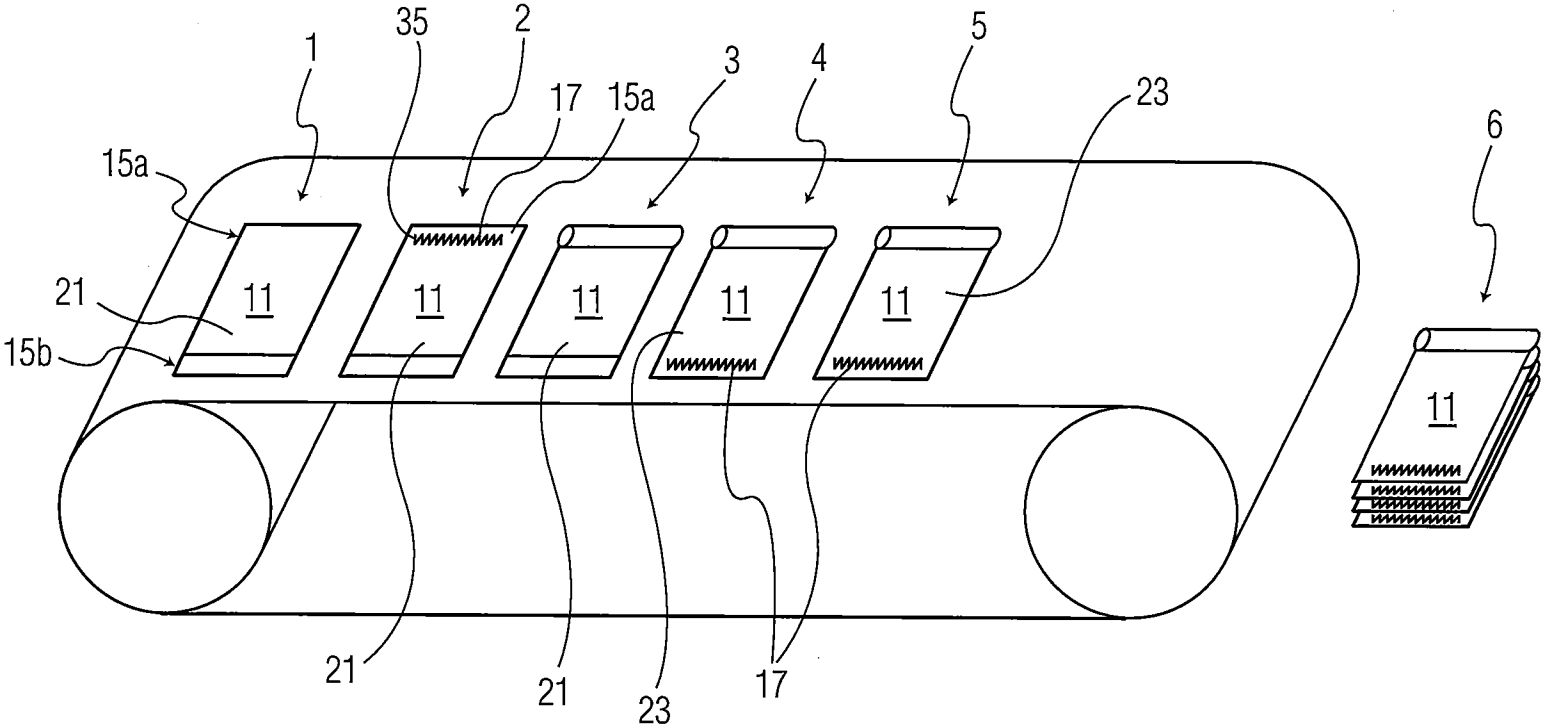
FIG. 1 is a schematic view of the adhesive application process of the present invention.

The present invention is directed to a method and system for regulating and controlling adhesive application. The system is a control system associated with an adhesive application system which applies adhesive to a substrate such as a bag. The control system performs a variety of functions including monitoring various variables in the application process, reducing defects during the application process by adjusting the process as a result of the monitoring data, and reporting monitoring results. While varieties of the present system may be used in a wide variety of industries, the system is particularly useful in formation of both ends 15, top and bottom, (15*a*,15*b*) of the pinching bottom bag process, as shown in FIG. 1. With reference to FIG. 1, in its broad aspect this is accomplished by positioning a bag 11 at step (1) with a bottom surface 21 to receive an application of adhesive 17; applying the adhesive 17 at step (2) along a portion of the bottom edge of the bottom end 15*a* of the bag 11 and folding the bottom end 15*a* of the bag 11 at step (3) to create a closed pinch bottom end 15*a* or manufacture's end. Next, the application of adhesive 17 is applied to the top surface 23 of other end or top end 15*b* of the bag 11. The adhesive 17 is applied along a portion of the top edge of the top end 15*b* of the bag 11. The next steps are (5) cooling and drying the adhesive 17 on the top end 15*b* of the bag 11, and (6) stacking the bags 11 for exporting to the customer leaving the top end 15*b* unsealed. The customer fills the bag 11 with product through the open top end and seals the bag 11 by applying heat to the pre-applied adhesive 17 on the top end. The top end is folded over and sealed with the product retained therein. As maybe appreciated the adhesive 17 must be delivered to the bag 11 at a specific temperature, amount and position to ensure proper adhesion and sealing of the bag end.

Figure 2:
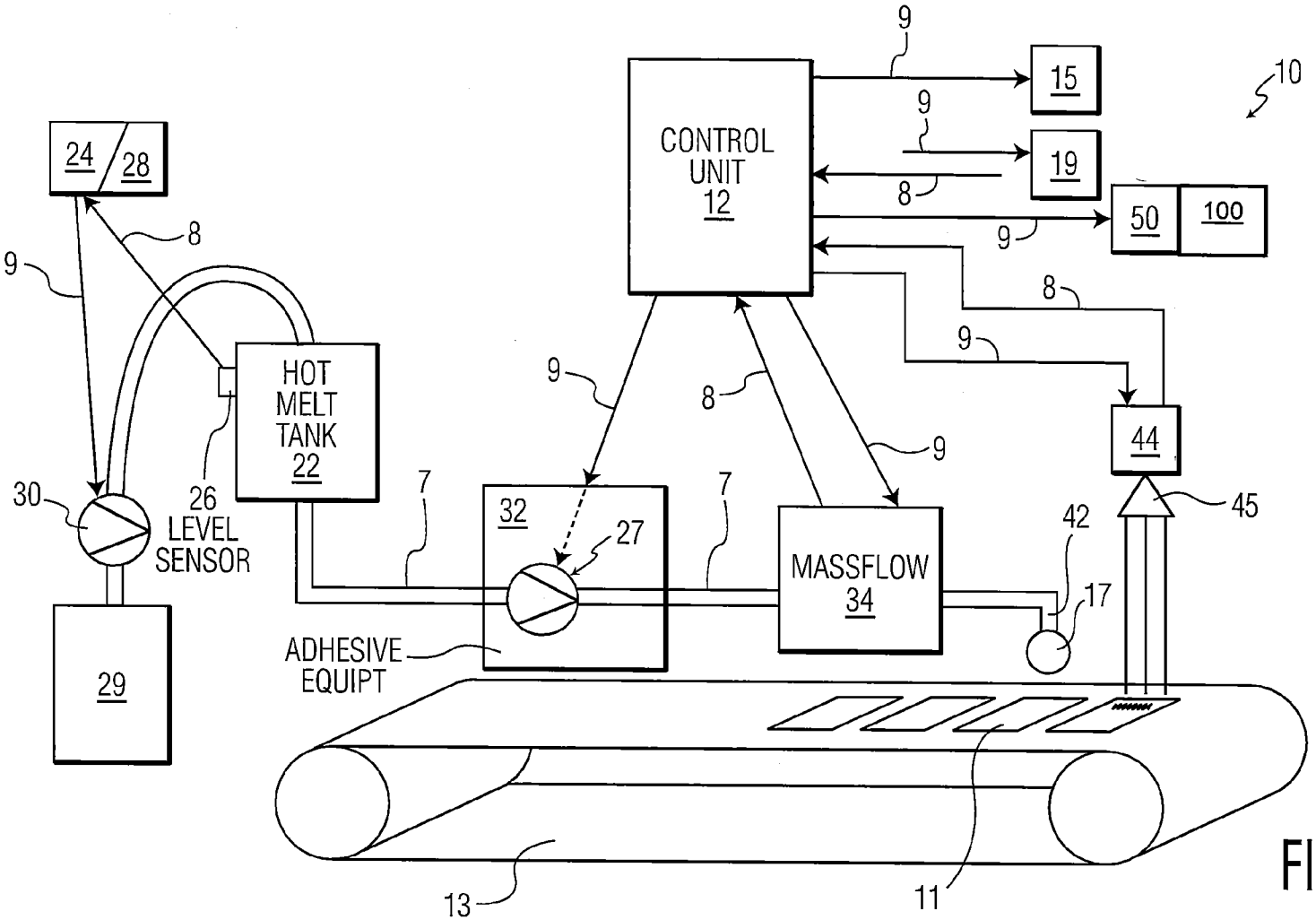
FIG. 2 is a schematic view of the adhesive application process and the monitoring system of the present invention.

The steps of applying (2),(4) the adhesive 17 to the bag 11 include the use of an adhesive system 10. FIG. 2 shows schematically the adhesive system 10 of the present invention which includes a hot melt tank 22, and a mass flow meter 34 with at least one applicator nozzle 42 connected together by a conduit or piping system 7 for carrying the adhesive 17. A mass flow meter 34 and a control unit 12 with associated data processing program, flow data sent to on-guard 36, are connected together by a transmission line 8. Graphical interface 19, such as a touch-screen, and a control unit 12 with the associated data processing program are connected together by a transmission line 8. A positioning detection system 44 and the control unit 12 with the associated data processing program are connected together by a transmission line 8. The control unit 12 with associated data processing program, a graphical interface 19, the adhesive equipment 32, the mass flow meter 34, and the defective detection device 50 are connected together by control lines 9.

Starting from the hot-melt tank 22, the adhesive 17 is delivered by an adhesive equipment 32 through a pipe system 7, which preferably comprises rigid and/or flexible pipes and may be cooled or heated, through the mass flow meter 34 to at least one applicator nozzle 42 where the adhesive 17 is applied to a substrate material or bag 11, disposed on a continuous or intermittent conveyor device 13. The adhesive equipment 32 includes various instruments (not shown), control panel (not shown) and equipment such as a heating element (not shown) and intermittent or continuous pump 27. The adhesive equipment melts the adhesive to a desired temperature, maintain the temperature of the molten adhesive and control the delivery and flow of the adhesive through the system to the application site or nozzle 42. For example, the pump 27 is used to generate pressure in the pipe system 7 to regulate flow of adhesive. While FIG. 2 shows that the pump 27 from the adhesive equipment 32 is in communication control with the control unit 12, it is contemplated the other equipment in the process may be controlled and/or monitored by the control unit 12 by use of transmission lines 8 and control lines 9.

The mass throughput of the adhesive 17 is measured by the mass flow meter 34 which is preferably positioned between the adhesive equipment 32 and the at least one applicator nozzle 42. The quantity of adhesive 17 flowing through the mass flow meter 34 is determined and transmitted to the control unit 12. The mass flow meter 34 may be regarded as part of an automatic control circuit which monitors the actual mass throughput of the adhesive 17 and signals changes to the control unit 12.

Figure 3:
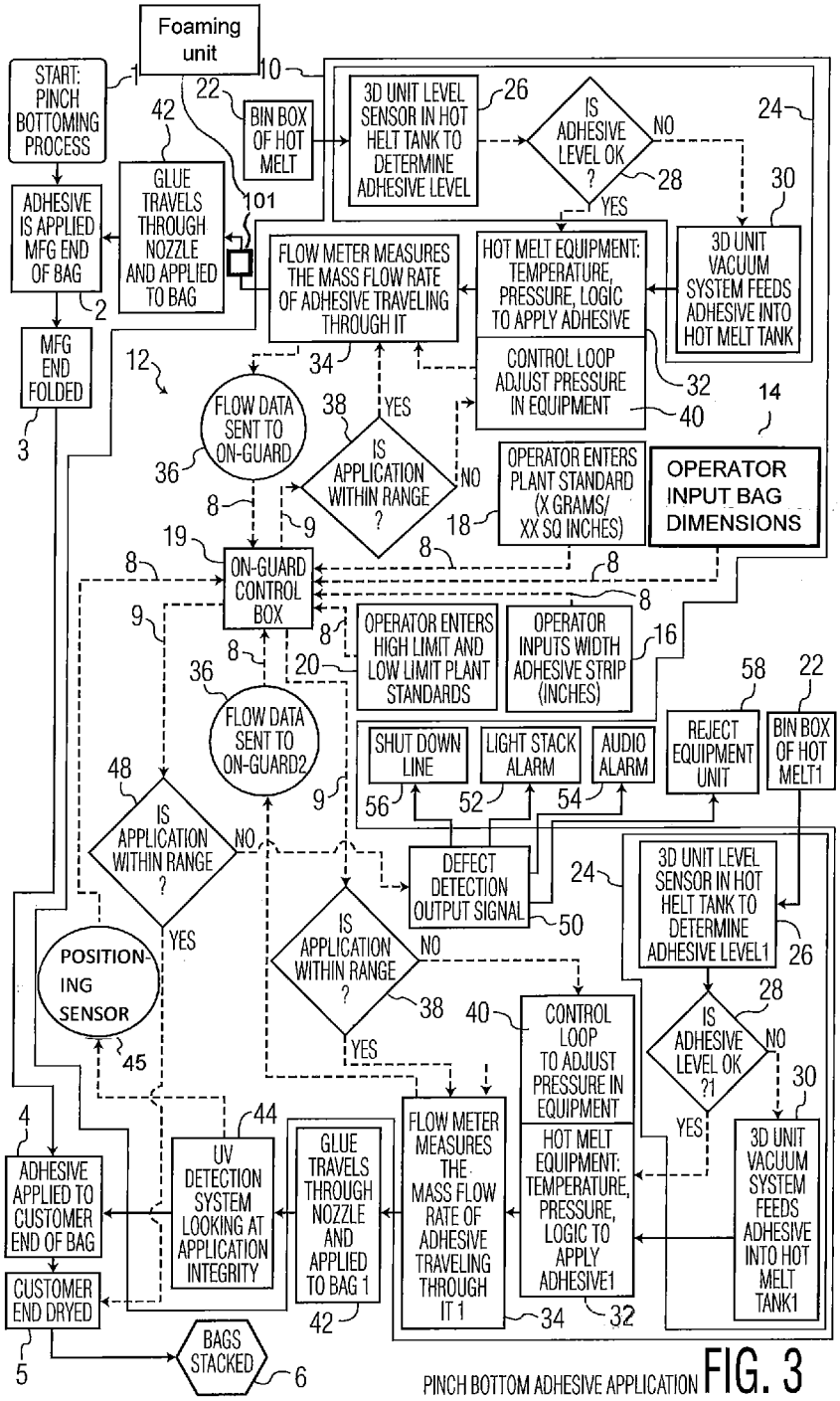
FIG. 3 is a flow diagram of the monitoring system of the present invention.
Figure 4:
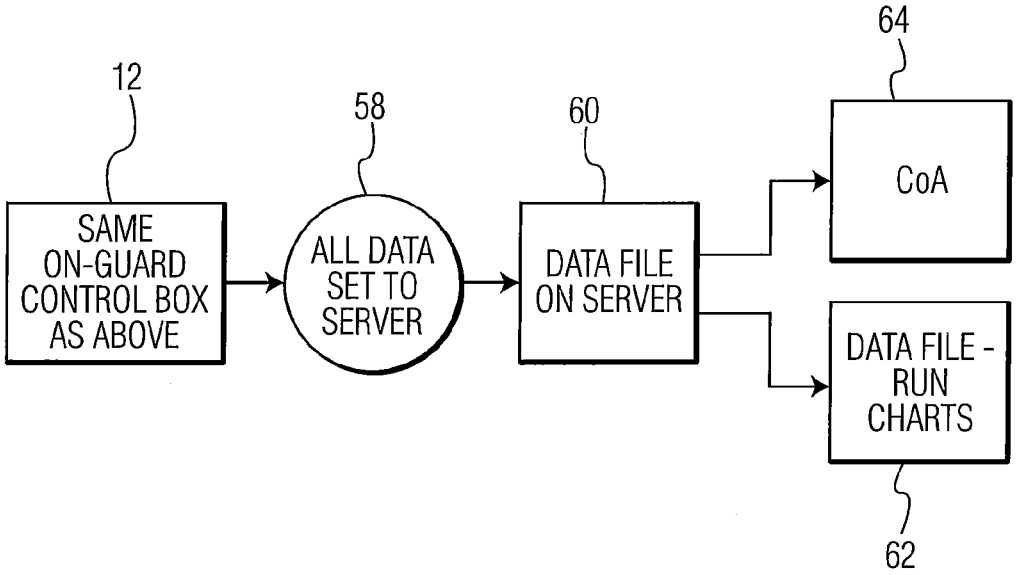
FIG. 4 is a flow diagram of the reporting capabilities of the monitoring system of FIG. 1.

With additional reference to FIGS. 2-4, the control system 10 of the present invention is shown. With reference to FIG. 2, the control system 10 includes adhesive equipment 32, control unit 12, detection system 44, associated transmission lines, control lines 9 and associated data processing programs to perform various functions such as collecting data, calculating and measuring, visually seeing the adhesive, comparing measured results to calculated or preprogrammed set point, creating alerts, sending instructions to various components in the adhesive process, adjusting the pressure or flow rate, responding to out of range elements, and reporting data and result. The detection system 44 can include an ultraviolet sensor 100.

The adhesive 17 starts off as pellets in a container 29 which is transferred into a hot-melt tank 22 by a vacuum feed system 30. The level and temperature of the adhesive 17 within the hot-melt tank 22 are monitored and adjusted to meet the target level and temperature to avoid viscosity issues or lack of raw material during the application process. The level component 24 includes level sensor 26, a level logic program 28, and a vacuum feed system 30 to monitor and adjust the adhesive 17 prior to use. The sensor 26 identifies the amount of adhesive 17 in the hot-melt tank 22 by measuring the level of adhesive 17 in the hot-melt tank 22. The sensor 26 sends the measured level to the logic program 28 through a transmission line 8. The logic program compares the previously programmed set-point level to the measured set-point level. If the levels are inconsistent, then the logic program 28 sends a signal through a control line 9 to the vacuum feed system 30 to draw adhesive 17 from the supplied container into the hot-melt tank 22. In reference to a low level measurement by the sensor 26, once the sensor measures the tank level at the target level, then the logic program instructs the vacuum feed system 30 to cease from drawing any further adhesive 17 to the reservoir tank 22. The temperature/level component 24 continually checks and adjusts the tank level throughout the application process.

When the adhesive 17 exits the hot-melt tank 22 and enters into the adhesive application system which directs the adhesive 17 from the hot-melt tank 22 to the bag 11. Adhesive equipment 32 measures the temperature and pressure in the adhesive system by use of sensors (not shown). The adhesive equipment verifies the target temperature of the adhesive 17 and the target pressure in the adhesive application system, such as the piping system 7, is satisfied. Additionally, the flow rate of the adhesive 17 through the system is controlled by the control unit 12 and adhesive equipment 32. If the control unit 12 determines that the flow rate of the adhesive is too slow, then the control unit 12 sends a signal to the adhesive equipment 32 through a control line 9. The adhesive equipment 32 receives the control signal and processes it to activate the pump 27 and increase the pressure in the lines 7 and increase the flow rate, and/or a signal is sent to a defective detection device 50 such as an alarm to alert the operator of a noncompliant event. Once the control unit 12 determines that the flow rate is within the target range, a signal is sent to the adhesive equipment 32 and the pump 27 is maintained or returns to the original state prior to the noncompliant event and/or a signal is sent to deactivate the alarm.

The adhesive 17 travels from the tank 22 to a mass flow meter 34. The mass flow meter 34 sends the flow rate measurements to the control unit 12 to determine if the correct amount of adhesive 17 is being applied along the designated adhesive path 35 on the bag. The control unit 12 includes a graphical interface 19 which allows for an operator to input various specifications, such as bag specifications and adhesive requirements, for the application of adhesive 17 on a series of bags. The control unit 12 can also display range limitations entered on the graphical interface 19. The control unit 12 may also display alarms and alerts on the graphical interface 19. Initially, the operator inputs information into the control unit, such as bag dimensions 14, width of adhesive strip 35 to be applied 16, the target total deposit of adhesive 17 to be applied 18 and high limit and low limit of the total target deposit 20. Additional information such as adhesive density may be pre-programmed into the control unit 12, to assist with the necessary calculations performed by the control unit 12. The control unit 12 uses this information to set the target range for this particular series of bags. For example, the control unit 12 calculates the area of the adhesive 17 needed per bag by multiplying the width of the bag (length of the adhesive strip 35) by the width of the adhesive strip 35.

The control unit 12 calculates the targeted total deposit of the adhesive 17 for each bag and the high and low limits based on the customer specifications entered into the control unit 12. Specifically, the customer enters the target deposit (D) of adhesive applied over a specific area; the target range including the minimum acceptable amount of adhesive (min) over a specific area, and the maximum acceptable amount of adhesive (max) over a specific area; the width of the bag which is the length of the adhesive path (L) and the width of the adhesive path (W). The control unit 12 calculates the target total deposit of adhesive (T) to be applied to each bag using the following equation:

$$T=D*L*W$$

Similarly, the calculated target range for each bag is calculated to determine the minimum calculated range (MN) and maximum calculated range (MX), as follows:

$$MN=\min*L*W$$

$$MX=\max*L*W$$

The calculated target deposits (T, MN and MX) are used to determine if the measured deposits during the application process meet the required customer standards. The calculated target deposits of adhesive 17 per bag are divided into equal target incremental deposit defining calculated target incremental deposits (ID, MNI, MXI) along each incremental distance (I) of the bag. The target incremental deposits (ID, MNI, MXI) are used to compare the measured deposits from the mass flow meter 34 delivered along each increment. The comparison is used to correct out of range errors and to verify that the adhesive 17 is being applied equally and consistently across the adhesive path. For example, the customer enters the target deposit (D) of adhesive applied over a specific area (i.e. D=0.9 grams/15 in2); the target range including the minimum acceptable amount of adhesive (min) over a specific area (min=0.7 grams/15 in2) and the maximum acceptable amount of adhesive (max) over a specific area (max=1.1 grams/15 in2); the width of the bag which is the length of the adhesive path (L) (L=30 in.) and the width of the adhesive path (W) (W=1.5 in.). The control unit 12 calculates the target total deposit of adhesive (T), the minimum calculated range (MN) and maximum calculated range (MX), as follows:

$$T=D*L*W=(0.9 \text{ grams}/15 \text{ in}^2)*(30 \text{ in.})*(1.5 \text{ in.})=2.7 \text{ grams}$$

$$MN=\min*L*W=(0.7 \text{ grams}/15 \text{ in}^2)*(30 \text{ in.})*(1.5 \text{ in.})=2.1 \text{ grams}$$

$$MX=\max*L*W=(1.1 \text{ grams}/15 \text{ in}^2)*(30 \text{ in.})*(1.5 \text{ in.})=3.3 \text{ grams}$$

Therefore, the target total deposit of adhesive per bag is 2.7 grams and the allowable range is between 2.1 grams and 3.3 grams. The control unit then divides these calculated amounts into equal incremental deposits (ID, MNI, MXI) along each incremental (I) distance of the bag, as shown below:

$$ID=T/I$$

$$MNI=MN/I$$

$$MXI=MX/I$$

For example, if the customer inputs the control unit will collect information from the mass flow meter at 3 points along the adhesive path per bag then the incremental value is 3 (I=3). The control unit 12 calculates and compares the application of adhesive three times along the adhesive path for each bag. Therefore, the target total deposit of adhesive per bag and the allowable range of adhesive deposit per bag is divided by the increment 3. Thus, the target incremental deposit (ID) is calculated to be 0.9 grams. The incremental allowable range is between MNI=0.7 grams to MXI=1.1 grams of adhesive. Therefore, the total target amount of adhesive applied to the bag is 2.7 grams and the adhesive is monitored by the control unit 12 at three points along the adhesive path and each point has a target incremental amount of adhesive of 0.9 grams in accordance with this example.

Based on the preprogrammed amounts, the control unit 12 calculates the amount of adhesive that must flow through the mass flow meter 34 for a specific amount of time in order to deliver an incremental deposit (ID). For example, based on the above-example, if the application of adhesive to each bag takes a total time (Tt) of 9 seconds, then 2.7 grams of adhesive must pass thorough the mass flow meter in 9 seconds to satisfy the target total deposit (T) per bag. Therefore, the incremental deposit (ID) of 0.9 grams of adhesive must pass through the mass flow meter in an incremental time (It) of 3 seconds based on an incremental value of 3 (I=3), as shown below:

$$Tt=It/I$$

The incremental deposit (ID) of 0.9 grams of adhesive is applied to each bag at three points (I=3) along the adhesive path to delivery a target total deposit (T) of adhesive of 2.7 grams per bag. The control unit 12 collects the measured mass flow rate of the adhesive 17 through the mass flow meter 34 for a specific increment of time (It) (i.e. 3 sec.). The control unit 12 receives the measured mass flow rate data and the flow logic program 38 compares the measured amount of adhesive traveling through the mass flow meter 34 for the increment of time (It) to the calculated target incremental deposit (ID). If the measured value equals the calculated value then the system is determined to be within the specification, and no adjustments are necessary and the adhesive 17 travels through nozzle 42 and is applied to a bag 11 at step (2). If the measured value is not equal to the calculated value then a signal is sent from the control unit 12 to a flow control loop 40 of the adhesive equipment 32. The flow control loop 40 adjusts the pressure in the piping system to increase or decrease the mass flow rate of the adhesive 17, such that the measured value is equal to the calculated value. The control unit 12 continuously performs comparisons to the calculated value and the target value which equates to three comparisons per bag (in this example) to verify that the total adhesive 17 applied to the bag is equally distributed across the bag at three different positions such as the lead edge, middle and trail edge. The comparisons and adjustments provide a consistent application of adhesive 17 across the bag edge. While three comparisons are discussed herein, it is contemplated that a plurality of comparisons may be performed in shorter integrals across each bag by the control system 10 to provide consistent application of the adhesive 17. Similarly, if the measured value is not equal to the target value then the control unit 12 compares the measured value to the target incremental deposits minimum (MNI) and maximum range (MXI). If the measured value is outside of the range then the control unit 12 will send a signal to adjust the pressure in the system and additionally will send a signal to alert the operator of a non-compliance using external alarms.

As shown in FIGS. 1 and 2, the adhesive 17 travels from the mass flow meter 34 through the nozzle 42 and applied onto the bag 11 at step (2). The bottom end of bag 11 is folded 3 at step 3 and the bag 11 proceeds through the production line to receive adhesive 17 to the top end, or customer end, of the bag 11 at step 4. Throughout the entire application process continuous controlling of the level, temperature and pressure of the hot-melt tank 22 and piping system 7 are performed as described above. If the level component 24 and the adhesive equipment 32 are providing measurement data that is within the specification then no adjustments to the hot-melt tank 22 of adhesive system are performed.

The adhesive 17 is applied to the top end in the same manner as the bottom end. The control system 10 performs the same functions as above-described with the bottom end application but further includes a positioning detections device 44. FIG. 3 shows two separate hot-melt tanks 22, two separate adhesive equipment 32, two separate mass flow meters 34, and two separate nozzles 42 are used in the adhesive system. One set of equipment for the application of adhesive on one end (bottom end) of the bag 11 and a separate set of equipment is used for the application of adhesive on the other end (top end) of the bag 11. Only one control unit 12 is used to monitor and control the equipment and sensors for the entire system including both sets of equipment. Additionally, only one positioning detection device 44 is used for the application of adhesive on the top end.

The adhesive 17 travels from the hot-melt tank 22 to the mass flow meter 34. The mass flow meter 34 transmits the measured mass flow rate data to the control unit 12 and the control unit 12 compares the calculated measured deposit amounts to the target deposit amounts. Adjustments are made as necessary and described above. The adhesive 17 travels from the mass flow meter 34 through the nozzle 42.

FIG. 3 shows that the top end application includes an additional step. As adhesive 17 is being applied to the bag, the control system 10 includes a positioning detection system 44 to ensure that the adhesive 17 is in the correct location on the bag 11 edge and avoid lack of adhesive 17 along the adhesive strip. The positioning detection system 44 monitors the consistency of the adhesive strip after the adhesive 17 is applied to the bag 11 but prior to drying and stacking of the bags. The positioning detection system 44 includes a positioning sensor 45 such as an ultra violet sensor positioned above the bag 11 to identify the positioning of the adhesive 17 on the bag 11. The control unit 12 sends a signal to the positioning detection system 45 through a control line 9 to instruct the positioning detection system 44 use its sensor 45 at specific time frames during the process to send data as to whether adhesive 17 is detected along the adhesive path during those time frames. The sensor 45 of the positioning detection system 44 detects adhesive or does not detect adhesive and transmit the recorded data to the control unit 12 through the transmission line 8. The control unit 12 uses a positioning logic program 48 to determine whether the recorded data is within the acceptable positioning limits based on the standards. If the results are within the acceptable limits then no action is taken and the adhesive 17 is dried and the bag 11 is stacked for shipment to a customer. If the results are not within the acceptable limits, such as a void in adhesive 17 or a skewed placement of adhesive 17 on the bag 11 end; then the logic program 48 sends a defective output signal to a defective detection device 50. The defective detection device 50 includes customized instructions to activate a visual alarm 52, an audio alarm 54, auto-line shutdown 56, rejection equipment 58 to remove the defective bag 11 or a combination of thereof.

The control system 10 includes a variety of action plans to alert the operator of the non-conformance in the application process when the control system 10 identifies a non-conformance. The control system 10 can activate a visual alert, such as a light stack including color coded lights to indicate all clear, target not met, or out of acceptable range limits. The system 10 can also activate an audio alert, such as and alarm, buzzer, or audio instructions for the operator. Additionally, the system 10 can activate a mechanism to reject the non-conforming bag 11 and remove it from the production line. Further, the control system 10 can activate an E-stop to shut down the production line to allow the operator to make adjustments, remove non-conforming bags, or redirect the bags as needed. The control system 10 is capable to activating individual alerts or a combination of alerts.

The control system 10 of FIG. 3 may further include a foaming unit 101 after the mass flow meter 34 and before the nozzle 42. The foaming unit aerates the liquid molten adhesive 17 changing the adhesive 17 from a liquid molten unfoamed state to a foam state. The volume of foamed adhesive 17 applied to a bag is the same as the volume of liquid molten unfoamed adhesive 17 applied to a bag. However, the mass of adhesive 17 in the foam state applied to a bag is less than the mass of adhesive 17 in the liquid molten unfoamed state applied to a bag. Quality is not compromised using the foamed adhesive 17 instead of the liquid molten unfoamed adhesive 17 because they both meet the required adhesion properties. Thus, the quality remains the same and the amount of adhesive 17 is required is reduced providing a savings in raw material input and costs.

FIG. 4 shows the control system 10 is capable of creating various reports based on the data received by the control unit 12. The data received throughout the application process is sent 58 to a database on a server 60. The server 60 formats the data to create various data charts. The data charts may be used for various purposes such as for quality assurance purposes, internal auditing purposes, or customer purposes such as a Certificate of Analysis (CoA) 64 or quality statement. The data charts can be run-charts 62 for each customer that shows the specifications and data points collected to show compliance. If non-compliance occurred, the data chart could show the non-conformity and measures taken to correct and eliminate the defective product. Additionally, the control system 10 can be hard-wired to a computer network for a log of product runs and manipulation of data for trouble shooting or improvement purposes.

Having described the preferred embodiments herein, it should now be appreciated that variations may be made thereto without departing from the contemplated scope of the invention. Accordingly, the preferred embodiments described herein are deemed illustrative rather than limiting, the true scope of the invention being set forth in the claims appended hereto.

What is claimed is:

1. A system for regulated and controlled application of adhesive to substrates comprising:

a) a container for containing a supply of adhesive in a plurality of pellets;

b) a hot-melt tank for containing a supply of adhesive;

c) a vacuum feed system for transferring the pellets from the container to the hot melt tank;

d) a level sensor in said hot-melt tank to automatically control the flow of adhesive through the vacuum pump;

e) at least one applicator nozzle;

f) a piping system for guiding the flow of adhesive from said hot-melt tank to said nozzle;

g) an application equipment located between said hot-melt tank and said nozzle;

h) a mass flow meter located between said sensor and said nozzle;

i) a control unit with an associated data processing program, said control unit being operable to control pressure in said piping system in response to the signals received from said mass flow meter, said control unit operable to program a minimum and a maximum acceptable amount of the adhesive over a specific area, and to regulate consistent and even application of adhesive to a substrate; and j) a positioning detection system located after said nozzle, said positioning detection system operable to identify the position and the minimum and the maximum acceptable amount of the adhesive on each substrate by sending a signal at specific time frames, said control unit being operable to control removal of defective substrate in response to the signals received from said positioning detection system.

2. The system of claim 1 wherein said positioning detection system includes an ultraviolet sensor.

3. The system of claim 1 wherein said control unit is operable to control the amount of adhesive applied to said substrate at two or more locations on said substrate.

4. The system of claim 1 further including a foaming unit, said foaming unit being located between said mass flow meter and said nozzle, said foaming unit operable to change said adhesive from a liquid state to a foam state.

5. A method for the controlled application of adhesive to a substrate comprising:

a) providing an adhesive application device comprising:

i) a container for containing a plurality of hot melt adhesive in a pellet form, ii) a reservoir tank for containing a supply of adhesive, iii) a vacuum feed system for transferring the plurality of hot melt adhesive to the reservoir tank, iv) a level logic program and a level sensor in the tank, v) a mass flow meter located between the tank and a nozzle, the reservoir tank and the nozzle being fluidly connected by a conduit system capable of transporting the adhesive, and vi) a control unit with an associated data processing program, the control unit being operable to program a minimum and a maximum acceptable amount of adhesive over a specific area, and to receive mass flow rate signals from the mass flow meter, and the control unit being operable to control a pump and heating element, b) employing the mass flow rate meter to measure the mass throughput of the adhesive defining measured mass flow data, c) transmitting the measured mass flow data to the control unit;

d) controlling the amount of pellets transferred to the tank from the container by the level logic program;

e) controlling consistent and even application of the adhesive on the substrate at a plurality of points along the substrate by continuous control of the mass throughput of the adhesive to be applied and selectively adjusting the output of the pump and heating element response to the mass flow rate signals; and f) employing a positioning detection system to determine the location of the adhesive on said substrate by a defining positioning results, transmitting the positioning results to said control unit, determining an amount of adhesive deposited on the substrate based on positioning results by detecting the minimum and the maximum amount of the adhesive over a specific area by said control unit, and removing nonconforming substrate based on determination by control unit.

* * * * *